United States Patent [19]

Benner

[11] 4,347,459

[45] Aug. 31, 1982

[54] MESH ASSEMBLY HAVING REDUCED MICROPHONICS FOR A PICK-UP TUBE

[75] Inventor: Timothy E. Benner, Lancaster, Pa.

[73] Assignee: RCA Corporation, New York, N.Y.

[21] Appl. No.: 202,769

[22] Filed: Oct. 31, 1980

[51] Int. Cl.[3] ..... H01J 29/08; H01J 31/38

[52] U.S. Cl. ..... 313/383; 313/378; 313/390

[58] Field of Search ..... 313/378, 390, 383, 376

[56] References Cited

U.S. PATENT DOCUMENTS

| | | | |
|---|---|---|---|
| 3,287,585 | 11/1966 | Randels | 313/390 |
| 3,325,672 | 6/1967 | Funahashi et al. | 313/390 X |
| 3,860,851 | 1/1975 | Hamersma | 313/390 X |
| 3,906,278 | 9/1975 | Horton et al. | 313/390 X |
| 4,323,814 | 4/1982 | Benner et al. | 313/390 |

*Primary Examiner*—Robert Segal

*Attorney, Agent, or Firm*—Eugene M. Whitacre; Dennis H. Irlbeck; Vincent J. Coughlin, Jr.

[57] ABSTRACT

A pick-up tube includes a generally cylindrical envelope having a faceplate at one end thereof and a cathode in the other end. A photoconductive target electrode is adjacent to the faceplate and a mesh assembly is disposed in spaced relation adjacent to the target electrode, between the target electrode and the cathode. The mesh assembly comprises a mesh electrode disposed between a frusto-conically shaped mesh support ring and a bow-shaped mesh damping ring. The mesh damping ring is fixedly attached at a plurality of points around its outer periphery to the mesh electrode and the mesh support ring. The inner periphery of the mesh damping ring is formed into a plurality of arcuately shaped regions extending therearound. Each of the arcuately shaped regions is interconnected by a portion of the damping ring which is in contact with the mesh electrode. The annular region between the inner periphery and the outer periphery of the bow-shaped damping ring and the axially extending region between the damping ring and the mesh electrode forms a vibration damping chamber having a plurality of entrances formed by the arcuately shaped regions of the damping ring.

7 Claims, 4 Drawing Figures

MESH ASSEMBLY HAVING REDUCED MICROPHONICS FOR A PICK-UP TUBE

BACKGROUND OF THE INVENTION

This invention relates to television pick-up tubes and particularly to an improved mesh assembly having reduced microphonics for such a tube.

Microphonics is a physical vibration of some portion of a tube which, because of its movement, produces an undesirable electrical signal output or noise which manifests itself as a background of lines or striations in a television picture.

In a vidicon type pick-up tube, a mesh grid is disposed between a photoconductive target and an electron gun which provides a scanning electron beam. The mesh provides a lens action which causes the electron beam from the electron gun to impinge perpendicularly on the target electrode. The mesh is usually supported around its periphery by at least one annular support ring.

When such tubes are subjected to mechanical shock, for example in vehicles or equipment, and vibration, for example, from cooling fans or incident sound from external sources, the conductive mesh will start vibrating relative to the photoconductive target and will cause microphonics effects which produce the above-described background lines and striations in the picture.

Many expedients such as rectangularly shaped damping members in contact with the mesh have been adopted to eliminate the undesirable microphonic effects. Such configurations provide a rectangularly shaped raster format and thus limit the orientation of the tube within a multitude color camera thereby complicating the tube alignment procedure. Among the other expedients adopted is a structure described in U.S. Pat. No. 3,906,278 to Horton et. al., issued Sept. 16, 1975 comprising a fine flexible mesh washer clamped between two annular members. The annular members are dished away from each other beyond the region of clamping. The flexible mesh washer extends inwardly beyond the region of clamping and contacts both the fine conductive mesh and the dished portion of one of the clamping members in order to damp vibrations. The Horton et al. structure is complex and requires a precisely formed flexible mesh washer. If the corrugations of the mesh washer are too shallow the washer will not contact both the dished annular member and the fine mesh. If this occurs, little or no damping will occur. Being constructed from mesh, the flexible washer also tends to undergo a change in elasticity after repeated thermal and mechanical cycling thus decreasing the effectiveness of the damping action. It is therefore desirable to find a low cost, reliable mesh mounting system which provides sufficient mesh tautness and damping to reduce microphonics.

One such mesh mounting system is described in copending U.S. patent application, Ser. No. 150,341, filed on May 16, 1980 by Benner et al., and entitled, "Mesh Assembly Having Reduced Microphonics For a Pick-Up Tube". The Benner et al. application is assigned to the same assignee as the present invention and is incorporated by reference herein for disclosure purposes.

The Benner et al. structure comprises a mesh electrode disposed between a frustro-conically shaped mesh support ring and a dished, i.e. frustro-conically shaped, spring-like mesh damping ring. The mesh damping ring is compressed into a reversal of its dished shaped and welded at a plurality of points to the outer periphery of the mesh support ring. By reversing the dished shaped of the mesh damping ring, the damping ring assumes an undulatory or serpentine configuration which contacts the mesh electrode periodically around the inner periphery of the damping ring. The area of contact extends radially outward from the inner periphery to the weld points at the outer periphery of the damping ring.

The aforedescribed Benner et al. structure is presently used in the RCA Vistacon, a trade name for a lead-monoxide vidicon. Vistacons using the Benner et al. mesh mounting system have excellent damping time of about 1 second or less. However, the Benner et al. structure requires accurate control of the temper of the mesh damping ring as well as proper weld placement at the periphery of the ring to assure that the damping ring assumes the proper undulatory configuration necessary to properly damp the mesh vibration. Improper damping ring temper or welding procedures reduce the number of periodically located contact points between the damping ring and the mesh and thereby decrease the damping efficiency of the mesh mounting system.

SUMMARY OF THE INVENTION

A pick-up tube includes a photoconductive target electrode, a mesh assembly disposed in spaced relationship therefrom, and a cathode. The mesh assembly comprises a mesh electrode disposed between an annular mesh support ring and an annular mesh damping ring. The mesh damping ring has a substantially bow-shaped cross-section extending from the inner to the outer periphery thereof. The mesh damping ring is fixedly attached at a plurality of points around its outer periphery to the mesh electrode and the mesh support ring. The inner periphery of the mesh damping ring is formed into a plurality of arcuately shaped regions extending therearound. Each of said arcuately shaped regions is interconnected by a portion of the damping ring which is in contact with the mesh electrode. The annular region between the inner periphery and the outer periphery of the cup-shaped damping ring and the axially extending region between the damping ring and the mesh electrode form a vibration damping chamber having a plurality of entrances formed by said arcuately shaped regions of said damping ring.

DETAILED DESCRIPTION OF THE PREFERRED EMBODIMENT

Figure 1:
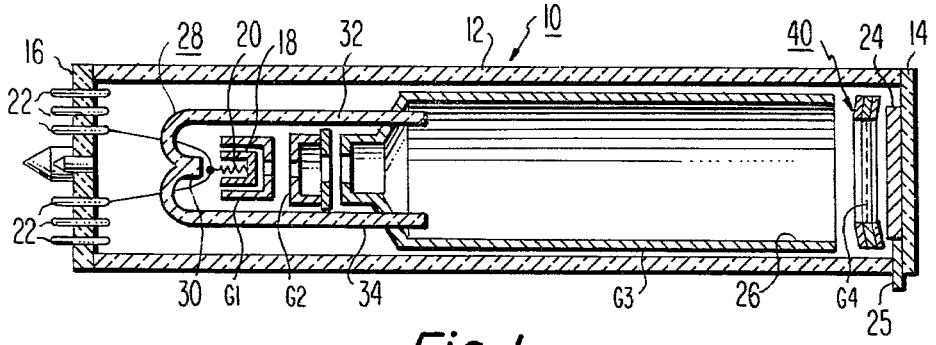
FIG. 1 is a cross sectional view of a pick-up tube showing the novel mesh assembly structure.

Referring to the drawings, there is shown in FIG. 1 a vidicon type pick-up tube 10 having a generally cylindrical glass envelope 12 closed at one end by a transparent glass faceplate 14 and at the other end by a glass base plate 16. The interior of the enclosed envelope 12 is suitably evacuated.

The tube 10 comprises a cathode 18 which is heated by a filament 20. The filament is suitably connected to two of a plurality of lead pins 22 which are vacuum sealed through the base plate 16. G1, G2, G3 and G4 are the normally provided electrodes known under those designations. A target 24 comprises a photoconductive layer of, for example, lead monoxide, selenium-arsenic-tellurium or another suitable material well known in the art. The photoconductive layer is deposited on a film of conductive tin oxide (not shown) on the inside portion of the faceplate 14. An electrical contact is made to the target 24 by a connector 25. The connector 25, typically a tab or strip of metal such as platinum, is connected to the target 24 and extends through the glass envelope 12 in a vacuum seal to make an external electrical connection.

The light scattering interior surface 26 of the anode electrode G3 may be roughened by chemical etching or sandblasting in a manner well known in the art. Light is directed into the interior of the anode electrode G3 by means of a bifurcated, rod-shaped light conductor 28. The light conductor 28 is bent in such a way that a part of the light irradiated by the filament 20 is guided through a stem 30 of the conductor 28 and thence through two branches, 32 and 34. The branches 32 and 34 are arranged to extend toward the target 24 and into the interior of the anode electrode G3 into which the light from the conductor 28 emanates.

As so far described, the lead monoxide target pick-up tube is known, per se. In such a prior art structure the G4 electrode is a fine conductive mesh or gauze made of electroformed copper or nickel although nickel is preferred. The G4 electrode includes about 1000 wires per inch in mutually orthogonal relation. This results in grid openings of about 0.0005×0.0005 inch (12×12 microns). The thickness of the grid is about 0.0002 inch (5 microns). The G4 electrode includes a support structure which may be formed of at least one but preferably two support rings. The support rings consists of chromium-nickel alloy when copper mesh is used and molybdenum, tantalum or Nichrome when nickel mesh is used. The mesh electrode is stretched tautly between the support rings and welded thereto.

According to the present novel structure, the G4 electrode assembly 40 is modified to provide a structure having reduced microphonics without additional and costly processing or complex damped spring structures and with a reproducibility of performance not achieved in the prior art. It has been found that the resonant frequency of a nickel mesh electrode 42, shown in exaggerated thickness in FIGS. 2 and 3, may be increased and the microphonics decreased by uniformly retaining and resiliently supporting the nickel mesh electrode 42 between a rigid frustro-conically shaped annular mesh support ring 44 and a spring-like annular mesh damping ring 46. The damping ring 46 has a bow-shaped cross-section and is secured to the mesh electrode 42 and to the mesh support ring 44 by welding around the outer periphery of the rings as shown in FIG. 3. The inner periphery 48 of the mesh damping ring 46 is formed into a plurality of arcuately shaped regions 50 extending therearound. Each of the adjacent arcuately shaped regions 50 is bent out of the plane of the mesh electrode 42. A plurality of contact portions 52 around the inner periphery of the mesh damping ring 46 contact the mesh electrode 42.

The nickel mesh electrode 42 is electroformed by a method well known in the art to have the desired mesh size described above. The mesh electrode 42 includes a substantially circular mesh portion 54 circumscribed by a solid, non-apertured annular portion 56 which provides increased weldability and vibration damping properties as will be described hereinafter. Subsequent to electroforming, the mesh electrode 42 is fired in dry hydrogen at 720° C. for 20 minutes to remove surface contamination from the mesh.

The rigid mesh support ring 44 preferably comprises molybdenum although Nichrome or tantalum may be used. The mesh support ring 44 has a thickness of about 0.020 inch (0.508 mm) and is slightly "dished" by placing the support ring between a punch and die (not shown) having an angle of about 6° to the horizontal to form a frustro-conically shaped ring. The mesh damping ring 46 preferably comprises molybdenum although Nichrome or tantalum may also be used. The mesh damping ring 46 has a thickness of about 0.002 to 0.005 inch (0.051 to 0.127 mm) and is slightly "bow-shaped". A punch and die method similar to the method described above for forming the support ring 44 also is used to form the mesh damping ring 46. However, in this instance, the die is embossed to form the arcuately shaped regions 50 equally spaced around the inner periphery of the damping ring 46. The punch and die also provide the bow-shaped cross section to the ring 46.

The embossed, arcuately shaped regions 50 formed around the inner periphery 48 of the damping ring 46 and interconnected by contact portions 52 provide a greater reproducibility of mesh contact points than was provided by the prior art structure disclosed in the Benner et al. application referenced above.

Reproducibility of the contact portions 52 is further enhanced by controlling and maintaining the temper of the mesh damping ring 46 to prevent fatigue during the operation of the tube. While proper part firing and annealing will control the initial temper of the part, sandblasting or equivalent peening procedures such as bead blasting can increase and maintain the temper of the molybdenum material preferred for the mesh damping ring 46. The molybdenum material is plated with about 0.0002 inch (5 microns) of nickel to improve weldability.

When the mesh support ring 44 and the mesh damping ring 46 comprise Nichrome or tantalum, the surfaces of the rings may be roughened, for example by sandblasting, bead-blasting or other methods well known in the art to improve temper. The nickel plating is not required if Nichrome or tantalum are used for the ring material since these materials have satisfactory weldability.

Figure 2:
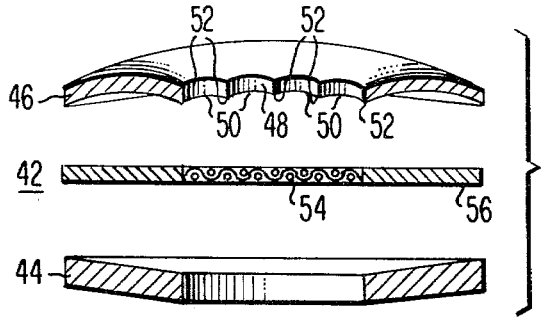
FIG. 2 is a partial exploded side view of the mesh assembly of FIG. 1.
Figure 3:
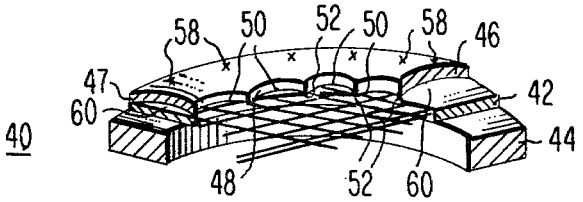
FIG. 3 is an enlarged fragmentary view of the mesh assembly showing the present novel structure in exaggerated detail.

As shown in FIGS. 2 and 3, the G4 electrode assembly 40 is formed by stretching the nickel mesh electrode G2 taut and disposing it between the mesh support ring 44 and the mesh damping ring 46. The apex of the frustro-conically mesh support ring 44 is directed away from the mesh electrode 42 and toward the cathode 18 (see FIG. 1). The mesh damping ring 46 is disposed on the mesh electrode 42 so that the arcuate regions 50 are arched upward and away from the mesh 42. Since the support ring 44 has about a 6° upturned edge from the horizontal, the bow-shaped damping ring 46 tends to tautly retain the mesh electrode 42 and thus increase the resonant frequency of the mesh electrode 42. As shown in FIG. 3, welded points 58 are equally spaced around the outer periphery 59 of the damping mesh ring 46 to hold the outer periphery of the mesh damping ring 46 in contact with the mesh electrode 42. Cross-sectional photographs of an electrode assembly such as assembly 40 show that the damping ring 46 also contacts the mesh electrode 42 periodically around the inner periphery of the damping ring at the locations of the interconnecting contact portions 52 of the mesh damping ring 46. An annular region 60 located radially between the inner periphery 48 and the outer periphery 47 of the mesh damping ring 46, and axially between the ring 46 and the mesh electrode 42 forms a vibration damping chamber. The vibration damping chamber 60 extends circumferentially around the mesh assembly 40. The vibration damping chamber has a plurality of entrances formed by the arcuately shaped regions 50 of the mesh damping ring 46. It has been determined that between about 18 to 36 mesh contact points or interconnecting contact portions 52 are required to obtain damping times of less than about 1 second. The above-described configuration permits any vibrations in the mesh electrode 42 to be propagated into the vibration chamber 60 between the mesh support ring 44 and the mesh damping ring 46. The vibrations entering the chamber 60 creates standing waves that interfere both constructively and destructively. Since the mesh damping ring 46 is spring-like but denser than the mesh electrode 42, the mesh damping ring 46 absorbs energy from the constructively interfering waves which contact the mesh damping ring 46 electrode thus suppressing mesh electrode vibrations and reducing microphonics. Destructively interfering waves in the mesh electrode 42 simply cancel each other.

Since the non-apertured portion 56 of the mesh electrode 42 is welded between the support ring 44 and the damping ring 46 there is a higher degree of weld integrity than could be obtained by welding to an apertured portion of the mesh electrode 42. The increase in density of the non-apertured portion 56 of the electrode 42 is also believed to contribute to the damping of mesh electrode vibrations.

Figure 4:
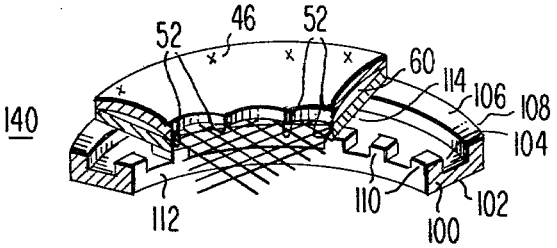
FIG. 4 is an enlarged fragmentary view of an alternative embodiment of the mesh assembly.

An alternative mesh electrode structure 140 is shown in FIG. 4. In this embodiment the frustro-conically shaped mesh support ring 44 is replaced by a mesh support ring 100 having a substantially flat base surface 102 which is directed toward the cathode 18 of FIG. 1. Oppositely disposed from the surface 102 is a second surface 104 having a sealing area 106 adjacent to the outer periphery 108 of the ring 100. A plurality of contact islands 110 are formed around the inner periphery 112 of the ring 100, e.g. by stamping. The islands are equally spaced with the chord between adjacent island being equal to the chord between adjacent arcuately shaped regions of the damping ring 46. The annular region between the inner periphery 112 and the sealing area 106 is recessed to form a circumferentially extending vibration damping chamber 114 between the mesh electrode 42 and the second surface 104. As shown in FIG. 4, the novel bow-shaped mesh damping ring 46 described above may be used to complete the electrode structure 140 or a substantially flat damping ring (not shown) may be welded around its periphery to complete the electrode structure. If the novel mesh damping ring 46 is used, the contact portions 52 of ring 46 are disposed opposite to the islands 110. In this configuration the circumferentially extending vibration damping chamber is formed above and below the mesh electrode 42. The chamber above the mesh electrode 42 is chamber 60 described above.

GENERAL CONSIDERATIONS

The novel mesh assembly 40 including the nickel mesh electrode 42 provides improvements over prior art mesh assembly structures. In such tubes as the RCA 4392, 30 mm lead-monoxide vidicon, trade named the Vistacon, prior art mesh assemblies exhibited natural resonant frequencies in the range of 2500 to 3200 Hz with damping time of about 1 second or less. In 30 mm Vistacons using the above described nickel mesh electrode secured between the frustro-conically shaped mesh support ring 44 and novel bow-shaped mesh damping ring 46, the average resonant frequency has been increased to about 3200 to 4000 Hz with average damping times of about 0.2 seconds.

It is within the scope of this invention to substitute an annular mesh support ring having substantially flat upper and lower surfaces for the frustro-conically shaped mesh support ring 44 of mesh assembly 40. Tests of such a modified mesh assembly indicate that the superior damping performances disclosed above for assembly 40 can be duplicated by the modified mesh assembly provided the mesh electrode 42 can be retained tautly between the flat mesh support ring (not shown) and the bow-shaped mesh damping ring 46.

What is claimed is:

1. In a pick-up tube having a generally cylindrical envelope, a faceplate at one end of said envelope, a photoconductive target electrode adjacent to said faceplate, a cathode in the other end of said envelope and a mesh assembly disposed in spaced relation adjacent to said target electrode between said target electrode and said cathode, the improvement wherein said mesh assembly comprises:

a mesh electrode disposed between an annular mesh support ring and an annular mesh damping ring, said mesh damping ring having a substantially bow-shaped cross-section extending from the inner periphery of said damping ring to the outer periphery thereof, said damping ring being fixedly attached at a plurality of spaced points around its outer periphery to said mesh electrode and to said mesh support ring, said inner periphery of said damping ring being formed into a plurality of arcuately shaped regions extending around said inner periphery, each of said arcuately shaped regions being interconnected by a portion of said damping ring which is in contact with said mesh electrode, the annular region between said inner periphery and said outer periphery of said bow-shaped damping ring and the axially extending region between said damping ring and said mesh electrode forming a vibration damping chamber extending circumferentially around said assembly and having a plurality of entrances formed by said arcuately shaped regions of said mesh damping ring.

2. The pickup tube as in claim 1 wherein said arcuately shaped regions are bent out of the plane of the mesh electrode and are equally spaced around the inner periphery of said mesh damping ring.

3. The pickup tube as in claim 1 wherein said annular mesh support ring is frustro-conically shaped.

4. The pickup tube as in claim 1 wherein said frustro-conically shaped support ring has an apex directed toward said cathode.

5. The pickup tube as in claim 1 wherein said mesh support ring has a substantially flat first surface directed toward the cathode and an oppositely disposed second surface adjacent to said mesh electrode, said second surface having a sealing area extending around the outer periphery thereof and a plurality of discrete mesh contact islands disposed around the inner periphery of said support ring and extending from the surface thereof, the annular region between said contact islands and said sealing area of said support ring forming a second vibration damping chamber between said mesh support ring and said mesh electrode.

6. The pickup tube as in claim 5 wherein said contact islands are equally spaced around said inner periphery of said support ring, the chord between adjacent islands being equal to the chord between adjacent arcuately shaped regions of said mesh damping ring.

7. The pickup tube as in claim 6 wherein each of said portion of said mesh damping ring interconnecting said plurality of arcuately shaped regions is disposed opposite to one of said islands of said mesh support ring.

* * * * *